US010712079B2

(12) United States Patent
Akalan et al.

(10) Patent No.: US 10,712,079 B2
(45) Date of Patent: Jul. 14, 2020

(54) COOLING DEVICE COMPRISING AN EVAPORATOR COVER SHEET HAVING A FIXING ASSEMBLY

(71) Applicant: BSH HAUSGERAETE GMBH, Munich (DE)

(72) Inventors: Yigit Akalan, Tekirdag (TR); Ziya Arslankiray, Tekirdag (TR); Mehmet Ciyanoglu, Istanbul (TR); Emre Emek, Istanbul (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 702 days.

(21) Appl. No.: 15/366,169

(22) Filed: Dec. 1, 2016

(65) Prior Publication Data

US 2018/0156526 A1 Jun. 7, 2018

(51) Int. Cl.

| | |
|---|---|
| ***F25D 23/00*** | (2006.01) |
| ***F25D 23/06*** | (2006.01) |
| ***F25D 23/08*** | (2006.01) |
| ***F25D 11/00*** | (2006.01) |

(52) U.S. Cl.

CPC ..... *F25D 23/006* (2013.01); *F25D 11/00* (2013.01); *F25D 23/065* (2013.01); *F25D 23/08* (2013.01)

(58) Field of Classification Search

CPC ..... F25B 39/022; F25D 23/006; F25D 23/06; F25D 2331/809; F25D 23/062; F25D 29/005; F25D 23/067; F25D 23/065; F25D 17/062; F25D 2317/0654; F25D 17/067; F25D 27/00; F25D 23/064; Y10T 29/53; A47L 15/4251; B29C 49/0047; B29D 99/001

See application file for complete search history.

(56) References Cited

U.S. PATENT DOCUMENTS

| | | | | | |
|---|---|---|---|---|---|
| 3,280,583 | A * | 10/1966 | Jones | F25D 17/065 | 62/285 |
| 5,727,859 | A * | 3/1998 | Jeong | F25D 23/006 | 312/404 |
| 5,784,896 | A * | 7/1998 | Tronnes | F25D 17/062 | 62/285 |
| 6,057,509 | A * | 5/2000 | Simmons | H02G 3/086 | 174/17 R |

(Continued)

FOREIGN PATENT DOCUMENTS

| | | | | |
|---|---|---|---|---|
| EP | 2667126 | A2 * | 11/2013 | F25D 23/006 |
| TR | 201010374 | A1 | 7/2012 | |
| WO | WO-2012113630 | A2 * | 8/2012 | F25D 23/006 |

*Primary Examiner* — Frantz F Jules
*Assistant Examiner* — Martha Tadesse
(74) *Attorney, Agent, or Firm* — Laurence A. Greenberg; Werner H. Stemer; Ralph E. Locher

(57) ABSTRACT

A cooling device having an evaporator for cooling a cooling chamber of the cooling device, including, a heat insulated cabinet; a housing, which is surrounded by the cabinet; an evaporator chamber for receiving the evaporator, wherein the evaporator chamber is closed by an evaporator cover sheet, which is fixed to a mounting element of the cooling device; and a fixing assembly, which is configured to releasably interlock the evaporator cover sheet with the mounting element by pushing the evaporator cover sheet towards the mounting element.

11 Claims, 12 Drawing Sheets

(56) References Cited

U.S. PATENT DOCUMENTS

| | | | | |
|---|---|---|---|---|
| 7,051,539 | B2 * | 5/2006 | Junge | F25D 17/045 62/187 |
| 8,020,400 | B2 * | 9/2011 | Neumann | F25D 23/063 62/298 |
| 8,047,017 | B2 * | 11/2011 | Lim | F25B 39/022 62/440 |
| 8,051,673 | B2 * | 11/2011 | Spiller | F25D 23/006 62/414 |
| 8,468,848 | B2 * | 6/2013 | Kwon | F25D 17/067 62/285 |
| 9,217,600 | B2 * | 12/2015 | Malisi | F25D 17/067 |
| 9,810,474 | B2 * | 11/2017 | Fernandez | F25D 23/062 |
| 10,302,345 | B2 * | 5/2019 | Lee | F25D 17/062 |
| 2003/0019222 | A1 * | 1/2003 | Takahashi | F25D 17/042 62/131 |
| 2009/0133425 | A1 * | 5/2009 | Goerz | F25D 17/067 62/264 |
| 2009/0308094 | A1 * | 12/2009 | Gorz | F25D 17/065 62/264 |
| 2010/0130094 | A1 * | 5/2010 | Michalk | A63H 33/062 446/111 |
| 2012/0144859 | A1 * | 6/2012 | Arslankiray | F25D 29/005 62/515 |
| 2012/0204581 | A1 * | 8/2012 | Kang | F25D 17/042 62/78 |
| 2012/0272670 | A1 * | 11/2012 | Choi | F25D 17/065 62/89 |
| 2012/0285193 | A1 * | 11/2012 | Choi | F25D 23/062 62/419 |
| 2013/0139540 | A1 * | 6/2013 | Eckartsberg | F25D 23/061 62/440 |
| 2015/0054395 | A1 * | 2/2015 | Arslankiray | F25D 25/025 312/404 |

* cited by examiner

COOLING DEVICE COMPRISING AN EVAPORATOR COVER SHEET HAVING A FIXING ASSEMBLY

BACKGROUND OF THE INVENTION

Field of the Invention

The present disclosure relates to a cooling device comprising an evaporator cover sheet having a fixing assembly.

A cooling device can be used to store a variety of goods in a cooling chamber at reduced temperature. The cooling device includes a refrigerant circuit, which inter alia comprises an evaporator, which in turn is configured to function as a cooler to cool surrounding air. The evaporator is positioned inside a housing surrounded by a cabinet with heat insulation. The evaporator is placed in an evaporator chamber, which is covered by an evaporator cover sheet, which is fixed to the housing of the cooling device. Through an air duct formed on the evaporator cover sheet, the cool air is transferred to an inner section of the housing.

In the Turkish patent publication TR201010374A1, a cooling device is illustrated having a top evaporator, wherein an evaporator chamber is formed inside the housing, and wherein the evaporator chamber is covered by a cover sheet. The evaporator cover sheet comprises a step shape and is fixed to the housing by screws.

In the U.S. Pat. No. 8,047,017, an assembly structure to fix an evaporator to a refrigerator is disclosed. The refrigerator comprises an evaporator, and a cover coupled to the evaporator. The evaporator comprises first fixing portions to be coupled with second fixing portions of the cover. The evaporator and the cover are fixed to each other without an external fastening element by using the first and second fixing portions.

SUMMARY OF THE INVENTION

It is therefore an object of the present disclosure to simplify assembly of the evaporator cover sheet inside the cooling device.

This object is achieved by way of the features of the independent patent claims. Further developments are the subject matter of the dependent claims, the description and the appended figures.

The present disclosure is based on the finding that the above object can be achieved by a fixing assembly of the cooling device, which enables to releasably or detachably interlock the evaporator cover sheet with the mounting element of the cooling device by pushing the evaporator cover sheet towards the housing.

A cooling device according to the present invention refers to a house-hold cooling device, which includes any cooling device, which is used in the house-hold in homes or in gastronomy. The cooling device functions to store food and/or beverages at certain temperatures, and comprises a refrigerator, a freezer, a chest freezer, a fridge-freezer-combination, an ice-box or a wine fridge.

According to a first aspect, the present disclosure relates to a cooling device having an evaporator for cooling a cooling chamber of the cooling device, comprising an heat insulated cabinet; an housing, which is surrounded by the cabinet; an evaporator chamber for receiving the evaporator, wherein the evaporator chamber is closed by an evaporator cover sheet, which is fixed to a mounting element; and a fixing assembly, which is configured to releasably or detachably interlock the evaporator cover sheet with the mounting element by means of pushing the evaporator cover sheet towards the mounting element.

As a result of the fixing assembly, the evaporator cover sheet can be effectively fixed to the housing by simply pushing the evaporator cover sheet towards the housing. One the one hand this allows to simplify the assembly process, since no or at least less additional fixing elements, such as screws, need to be present and one worker can fix the evaporator cover sheet into place, i.e. attach it to the mounting element. On the other hand an appealing design of the cooling device and an improved cleaning capability can be achieved, since no or at least less additional fixing elements, e.g. screws, need to be incorporated into the design. Therefore no or less screw connections are visible to a user of the cooling device and less regions where dirt can accumulate and which are difficult to clean are present.

The releasable or detachable interlock between the evaporator cover sheet and the mounting element allows to perform maintenance of the cooling device, for example to work on and/or exchange the evaporator. The interlock shall in particular be nondestructively releasable. Further, the interlock between the evaporator cover sheet and the mounting element may be releasable without the use of tools, in particular by hand. For example the interlock may be released by pulling the evaporator cover sheet away from the mounting element, e.g. in a direction opposite to the direction it was fixed. However, it is also conceivable that the interlock may be released by employing a release tool, e.g. a longish element to push onto the release element.

The fixing assembly may be configured to carry at least partly a weight force of the evaporator cover sheet, in particular in case the cooling device is positioned in a usable orientation, that is standing upright. While in this case still an additional fixing connection, e.g. by a additional fixing elements such as screws, is necessary to completely assemble the cooling device, the assembly process is nevertheless improved. For example the fixing assembly may help to correctly align or position the evaporator cover sheet with respect to the mounting element and thus to the housing and therefore simplifying the process of establishing the additional fixing connection is achieved. Furthermore the additional fixing connection can be embodied smaller and/or less additional fixing elements may be necessary. The design and the cleaning capability can be improved in this way.

The fixing assembly may be configured to carry completely a weight force of the evaporator cover sheet, in particular in case the cooling device is positioned in a usable orientation, that is standing upright. In this way the assembly process, the design and/or the cleaning capability is even further improved. An additional fixing connections is not necessary. Nevertheless, an additional fixing connection may nevertheless be provided, for example to further reduce the possibility that a user may unintentionally remove the evaporator cover sheet.

The evaporator cover sheet may additionally be fixed to the mounting element and/or to a further mounting element of the cooling device by an additional fixing connection. The additional fixing connection may be embodied as a screw connection. A longitudinal axis of the screw connection may be orthogonal to a direction along which the evaporator cover sheet is pushed towards the mounting element when the evaporator cover sheet is fixed to the mounting. This may further increase the stability of the fixing assembly, in particular the releasabilty of the fixing connection can be blocked by the screw connection. In case the cooling device comprises a lateral side element, a screw connection between the evaporator cover sheet and the lateral side element may be provided. Using the lateral side element allows to design a sufficiently strong screw connection without the need to weaken the housing, e.g. the inner liner. In particular, the lateral side element and/or the evaporator cover sheet may be provided with a screw hole. A longitudinal axis of the screw connection may be vertical. This allows to hide the screw head from a user.

The mounting element may be embodied by the housing. In particular the housing may embody or comprise an inner liner and the mounting element may be embodied by the inner liner. The inner liner may be made of plastic or metal or a combination of both.

Alternatively or additionally the mounting element may be embodied at least partly or completely by an element being separate from the housing. In particular the element may be permanently fixed to the housing, i.e. by a substance-to-substance bond or by an adhesive bond, or may be releasably or detachably fixed to the housing, e.g. by a form-fit and/or force-fit connection, in particular by a screw connection. In case of a releasably or detachably fixed mounting element, a connection between the mounting element and the housing may be covered by the evaporator cover sheet. The mounting element may be embodied by a lateral cover sheet fixed to the housing. The lateral cover sheet may be, in particular detachably, fixed to a side wall of the housing. There may be two lateral cover sheets each fixed to opposing side walls of the housing. In case of two lateral cover sheets these may be mirror symmetrical or identical elements. The lateral cover sheet may be made of plastic, in particular may be an injection molded part. The lateral cover sheet may be a flat part, i.e. a thickness of the lateral cover sheet may be less than 30 times or less than 20 times or less than 10 times of a largest extension of the lateral cover sheet. A thickness of the lateral cover sheet may essentially be constant throughout the lateral cover sheet. A thickness of the lateral cover sheet may be in the range of 0.25 cm up to 10 cm or in the range of 0.5 cm to 5 cm. This allows attaching the lateral cover sheet to the housing without a significant reduction in the available volume of the cooling chamber while still parts of the fixing assembly can be sufficiently integrated into the lateral cover sheet. The evaporator may be fixed to the lateral cover sheet. The lateral cover sheet may at least partly or least largely or completely carry a weight force of the evaporator. Alternatively, the evaporator may be fixed to the housing and/or other elements of the cooling device only. In particular the evaporator may not be fixed to the lateral cover sheet. This allows designing the lateral cover sheet purpose specific only for the fixation of the evaporator cover sheet. Employing a mounting element being a separate element with respect to the housing allows in a simple and efficient way to incorporate parts of the fixing assembly into the mounting element. In particular the housing, e.g. the inner liner, may be made at least partly of metal whereas the lateral cover sheet may be an injection molded plastic part.

In case the cooling device comprises a lateral cover sheet said lateral cover sheet may embody a stopper onto which the evaporator cover sheet abuts. A lateral cover sheet embodying a stopper may be part of the cooling device irrespective whether the lateral cover sheet embodies a part of the fixing assembly or not. The description and features of the lateral cover sheet embodying a part of the fixing assembly may nevertheless be applicable. The lateral cover sheet may have a front surface extending along the thickness of the lateral cover sheet and the stopper may be embodied on this and/or by this front surface. The stopper may be embodied by at least two or several flat surfaces of the lateral cover sheet which are in particular oriented inclined with respect to each other. The lateral cover sheet may have a stepped shape of the front surface being complementary to a stepped shape of the evaporator cover sheet.

The description and features relating to the mounting element are applicable likewise to the further mounting element.

According to one example, the fixing assembly may comprise a locking element positioned at the evaporator cover sheet or at the mounting element, wherein the fixing assembly comprises a mounting recess positioned at the other one of the evaporator cover sheet and the mounting element, and wherein the mounting recess is configured to receive the locking element. As a result, the locking element is received by the mounting recess by pushing the evaporator cover sheet towards the housing, thereby achieving an effective fixation between evaporator cover sheet and housing. In an additional embodiment, the housing can comprise a plurality, e.g. two, of mounting recesses, wherein each mounting recess is configured to receive an individual locking element. The locking element may be a locking protrusion.

According to one example, the locking element may comprise a cylindrical portion and the mounting recess may be configured to receive the cylindrical portion. The cylindrical portion may simplify the insertion into the mounting recess and may ensure a strong connection of the fixing assembly and yet allows a simple to produce fixing assembly. The cylindrical portion may be embodied as a cylindrical sleeve. The cylindrical portion may comprise a fixing hole. In particular a screw may be inserted through the fixing hole by which the cylindrical portion is fixed to the evaporator cover sheet or the mounting element.

The cylindrical portion may be embodied by a substantially cylindrical part and/or may be made of plastic, e.g. a thermoplastic.

According to one example, at least one locking latch is positioned in the mounting recess, wherein the at least one locking latch is configured to interlock the locking element within the mounting recess. As a result, after insertion of the locking element into the mounting recess, the locking latch prevents that the locking element can be withdrawn from the mounting recess. In an additional embodiment, the locking latch may be formed as an elastic locking latch, which snaps back after insertion of the side locking element, thereby tightly fixing the side locking element within the mounting recess. The locking latch may be elastically deformable, in particular reversibly deformable and in further particular repeatedly reversibly deformable. The locking latch may in particular be elastically deformable due to its design and/or due to its material characteristics. In case the locking latch may be deformable due to its design, the insulation element may be made at least partly or at least mostly or entirely of a thermoplastic material.

According to one example, the locking element may comprise a head section, which connects the locking element with the evaporator cover sheet or with the mounting element, and the locking element may comprise a foot, which is inserted into the mounting recess, wherein the foot and the head section are connected by a leg of the locking element. As a result, the head section of the locking element provides an effective fixation of the locking element at the evaporator cover sheet or the mounting element, while the foot allows for an efficient interlocking assembly between the locking element and the mounting recess.

According to one example the locking element may be fixed to the evaporator cover sheet or to the mounting element at least by a screw connection. In this way a simple but sufficiently strong connection may be realized and/or the production of the locking element can be simplified.

According to one example, the cooling device may comprise a lateral cover sheet, which may be fixed to the housing, and wherein the mounting recess is provided at a sheet edge of the lateral cover sheet. As a result, an efficient fixation between evaporator cover sheet and lateral cover sheet is achieved. Thereby, the locking element can be efficiently inserted into the mounting recess. In an additional embodiment, the lateral cover sheet can comprise at least two, in particular exactly two, or a plurality of mounting recesses, wherein each mounting recess is configured to receive an individual locking element. The mounting recess may extend through the complete thickness of the lateral cover sheet. The mounting recess may form an opening which is open towards the edge. The mounting recess may include at least one locking latch which may be positioned on a side wall section of the mounting recess. The mounting recess may include two locking latches which are positioned on two opposing side wall section of the mounting recess. The mounting recess may a include a channel starting at the edge and leading to a mounting region where the latching element(s) is/are positioned. In this way the mounting region can be positioned further away from the edge, i.e. more inwardly within the lateral cover sheet. The mounting region and if present also the latching element(s) can therefore be designed very strong. The mounting recess provided at a sheet edge may in particular be provided at a downward facing sheet edge or a forward facing sheet edge or an inclined forward and downward facing sheet edge, thus simplifying the interlocking process.

The evaporator cover sheet may have a stepped shape and if the cooling device comprises a lateral cover sheet, a front edge of the lateral cover sheet may also have a stepped shape to The evaporator cover sheet may be made of metal, in particular of sheet metal.

Those parts of the fixing assembly which are mounted to or embodied on the evaporator cover sheet, e.g. the locking recess or the mounting recess, may be embodied in edge regions of the evaporator cover sheet. This allows a simple attachment or embodiment of these parts of the fixing assembly to the evaporator cover sheet as well as a stable fixation of the evaporation cover sheet to the mounting element.

According to one example, the evaporator cover sheet may comprise a mounting recess, in form of a locking hole. According to one example, the evaporator cover sheet may comprise an inwardly oriented flange on which a locking hole is positioned embodying the mounting recess. The locking hole may receive the locking element. In this way a simple to produce but effective mounting recess can be obtained. In case the evaporator cover sheet is made of sheet metal, the locking hole may be a punched hole. By providing the locking hole on the flange, the locking hole can be positioned on an edge portion of the evaporator cover sheet, thus enabling a fixing assembly which can be covered by the evaporator cover sheet. The inwardly oriented flange may be aligned substantially parallel to a side wall or a top wall of the housing and/or the lateral cover sheet.

According to one example, the fixing assembly may essentially be completely covered by the evaporator cover sheet. This further improves the design and/or cleaning capability.

It may be possible that the fixing assembly may be releasable by pulling the evaporator cover sheet away from the mounting element, e.g. in a direction opposite to the direction it was fixed. This may allow to release the interlock between the evaporator cover sheet and the mounting element. According to one example, the fixing assembly may comprise, however, a release element to release the interlock between the evaporator cover sheet and the mounting element. This reduces the possibility of unintentionally removing the evaporator cover sheet. The release element may release the interlock between the evaporator cover sheet and the mounting element once activated. The release element may be activated by pushing onto or pulling at an activation element and/or activation surface of the release element. In particular, it may not be necessary to additionally pull the evaporator cover sheet away from the mounting element, e.g. in a direction opposite to the direction it was fixed, in order to activate the release element. The release element may be activated by hand and/or by a release tool such as a screw driver. The release element may allow the locking element to leave the mounting recess in a non-destructive way at all or at least with a reduced force. The release element may for example elastically deform a locking latch such that the locking element may be able to leave the locking protrusion.

The release element may be located at least partly or least largely or completely within the evaporator chamber. This further improves the design and/or cleaning capability and further reduces the risk of unintentional activation of the release element. The evaporator cover sheet may comprise an opening through which the release element can be activated. In particular the opening may be configured such that a release tool, e.g. bar or screw driver shaft, may be insertable. The evaporator cover sheet may include one or several air inlet and/or air outlet openings and one of such openings may be configured as opening through which the release element can be activated. In particular the opening through which the release element can be activated may be located in the proximity of the release element, for example within a distance of less than 10 cm or less than 5 cm or less than 3 cm.

According to one example, the locking element may comprise a mounting section, an interlocking section and an elastic section which connects the mounting section and the interlocking section in a bendable or tiltable or flexible way. The mounting section may comprise a mounting hole through which the mounting section can be connected to the evaporator cover section or the mounting element by a screw. The locking element may comprise an attaching hook formed at the interlocking section of the locking element. The attaching hook may be inserted into a mounting recess, e.g. locking hole, of the evaporator cover section or the mounting element (to which the locking element is not connected via the mounting section), to releasably interlock the evaporator cover sheet with the mounting element. The elastic section may comprise a hinge, e.g. a film hinge, to elastically tilt the interlocking section with respect to the mounting section. The interlocking section may comprise a release element. The release element may lie opposite to the attaching hook with respect to the elastic section. The release element may be activated by pushing it, e.g. with a release tool such as a screw driver, towards the mounting section. The locking element may be made of one piece, e.g., by production from one single cast and/or by manufacturing in a one-component or multi-component injection-molding process, and in particular from a single blank The cooling device may comprise at least two or several fixing assemblies as described herein. The fixing assemblies may be of the same type or of a different type. In one example, the cooling device may comprise two lateral cover sheets each having one mounting recess and two locking elements provided at the evaporator cover sheet, wherein each mounting recess of the lateral side element receives one of the two locking elements and wherein the evaporator cover sheet comprises further two mounting recesses in form of locking holes, wherein the two locking holes receive each a locking element fixed to the housing, e.g. a top wall of the housing. Additionally, the cooling device may include two additional fixing connections in form of screw connections which embody a screw connection between the evaporator cover sheet and the lateral side elements.

According to one example, the evaporator cover sheet comprises a display and/or control cover section, wherein the display cover section includes a display unit and/or control unit for displaying and/or setting cooling parameters of the cooling device, and wherein the evaporator cover sheet comprises fastening elements for fixing the display cover section.

According to one example, the fixing assembly is embodied in a first section of the evaporator cover sheet and an additional fixing connection, in particular a screw connection, is embodied in a second section of the evaporator cover sheet, whereas the first section is positioned in front of the second section in depth direction of the cooling device. In this way the design and/or the cleaning capability of the cooling device can be further improved. In particular the fixing assembly is provided in a first half or in a first third of the extension of the evaporator cover plate in depth direction of the cooling device.

According to a second aspect, the present disclosure relates to a cooling device production method for producing a cooling device, in particular according to the first aspect, wherein the cooling device production method comprises the following steps, aligning the evaporator cover sheet at the mounting element to close the evaporator chamber, and pushing the evaporator cover sheet towards the mounting element to activate the fixing assembly to fix the evaporator cover sheet at the mounting element. As a result, the production process of the cooling device is accelerated.

The method may include the further step of fixing the evaporator cover sheet to the to the mounting element and/or to a further mounting element by screwing it to the mounting element and/or to a further mounting element.

According to a third aspect, the present disclosure relates to a cooling device having an evaporator for cooling a cooling chamber of the cooling device, comprising an heat insulated cabinet; an housing, which is surrounded by the cabinet; an evaporator chamber for receiving the evaporator, wherein the evaporator chamber is closed by an evaporator cover sheet, which is fixed to a mounting element; and a fixing assembly, which is configured to releasably interlock the evaporator cover sheet with the mounting element by means of a form-fit and/or force-fit connection between the evaporator cover sheet and the mounting element. The description and features of the first and second aspect may be applicable also to the third aspect. In particular, the fixing assembly may be a screwless connection.

BRIEF DESCRIPTION OF THE SEVERAL VIEWS OF THE DRAWING

Further examples of the principles and techniques of that disclosure are explained in greater detail with reference to the appended drawings, in which.

DETAILED DESCRIPTION OF THE INVENTION

Figure 1:
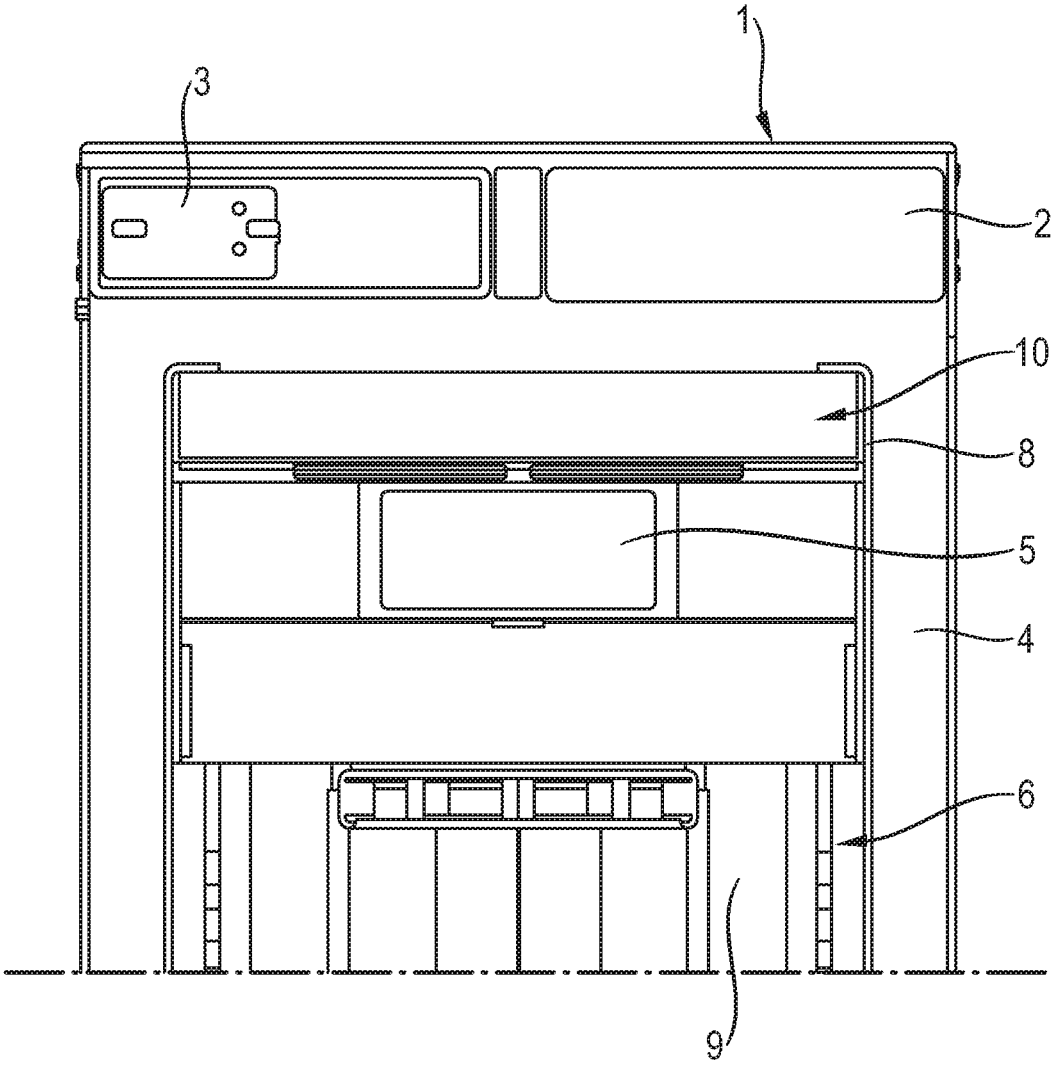
FIG. 1 shows a frontal view of a cooling device comprising an evaporator cover sheet having an assembly mechanism according to the present disclosure.

FIG. 1 shows a frontal view of a cooling device comprising an evaporator cover sheet 10 having an assembly mechanism according to the present disclosure. FIG. 1 shows a cabinet 1 of a domestic cooling device in frontal view. The cabinet 1 surrounds a housing 6, which comprises heat insulated walls and is placed at an inner section of the cabinet 1. A hinge 3, which is configured to attach a door in an openable manner, is fixed at an upper cabinet section 2, which is located on the outer front face of the cabinet 1. The door is not illustrated in FIG. 1. The outer walls of the cabinet 1 form one column 4 on each of the lateral sides, wherein the housing 6 can be accessed through an opening confined by the columns 4. The evaporator cover sheet 10 is placed at an upper housing section of the housing 6. The evaporator cover sheet 10 closes an evaporator chamber 7, which is positioned on the housing 6 ceiling and a remaining inner housing section. The evaporator cover sheet 10 extends from the column 4 up to a rear wall 9 of the housing 6. Further, the cooling device comprises a fixing assembly 8, which is configured to fix the evaporator cover sheet 10 at the housing 6. Furthermore, the evaporator cover sheet 10 comprises a display 5, which displays the cooling functions of the cooling device.

Figure 2:
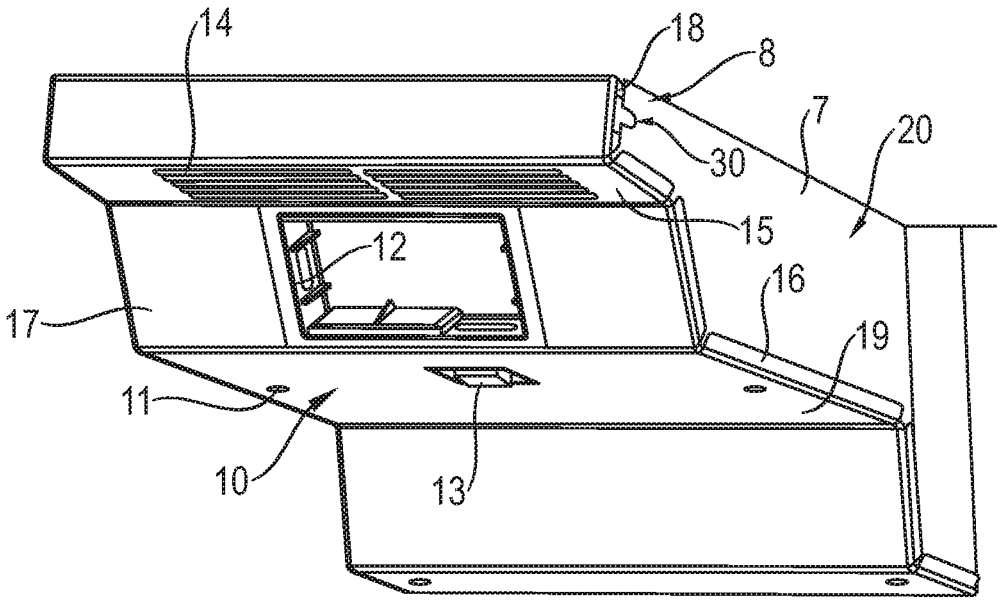
FIG. 2 shows a perspective view of the evaporator cover sheet in dismantled form according to a first embodiment of the present disclosure.

FIG. 2 shows a perspective view of the evaporator cover sheet in dismantled form according to a first embodiment of the present disclosure. The evaporator cover sheet 10, which is formed in step shape, has an upper cover section 18 with an inwardly oriented flange and which is in this embodiment positioned at a distance with respect to the ceiling of the housing 6. A locking element 30, positioned at a side a right side of the evaporator cover sheet 10, of a fixing assembly 8 is placed close to the edge of the upper cover section 18 facing towards the evaporator chamber 7. The upper cover section 18 extends into a ceiling front cover section 15 by bending the upper cover section along the lower edge, wherein the ceiling front cover section 15 comprises air ducts 14 configured to provide air transfer between the evaporator chamber 7 and the interior of the cooling device.

The ceiling front cover section 15 is separated from a display and/or control cover section 17 by means of bending the ceiling front cover section 15 along the lower edge. The display and/or control cover section 17 is formed in an angled position ensuring that the display and/or control cover section 17 can be viewed easily from the outside. A collar 12 is aligned to the middle of the display and/or control cover section 17, which has an angled position so it can be viewed easily from the outside. The display and/or control cover section 17 extends into the ceiling rear cover section 19 by bending along a lower edge of the display and/or control cover section 17. Fastening elements 11, namely screws, which are positioned on the ceiling rear cover section 19, facilitate assembly of the evaporator cover sheet 10 at the housing 6. A switch 13 is provided at the ceiling rear cover section 19.

The evaporator cover sheet 10 is bent towards the evaporator chamber 7 along lateral cover edges 16 or flanges. A lateral cover sheet 20 is fixed to the housing 6. The evaporator cover sheet 10 is fixed to the lateral cover sheet 20 by the fixing assembly 8 and an additional fixing assembly in form of the screw connection.

Figure 3:
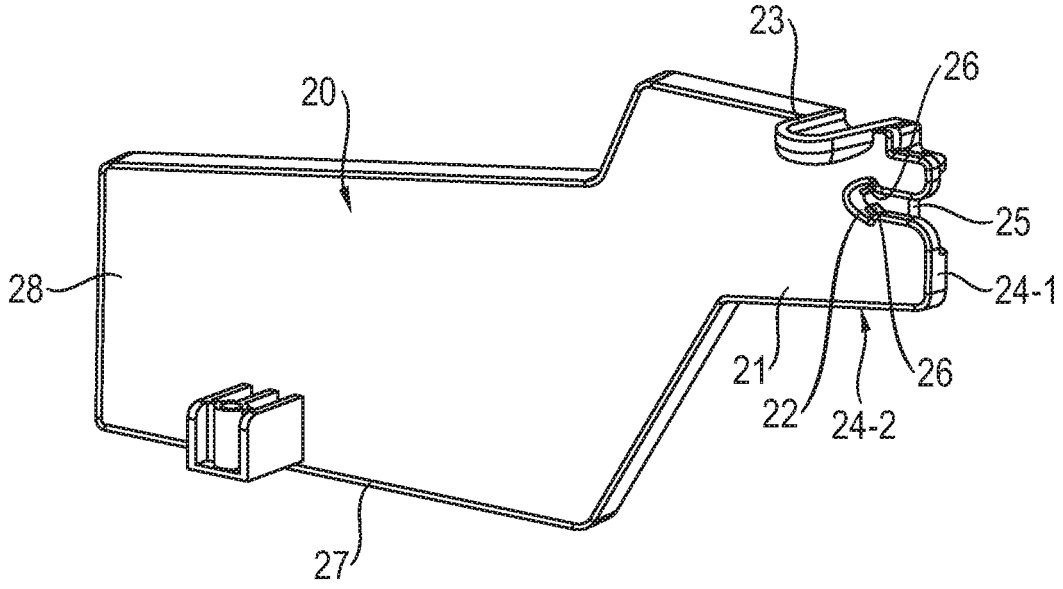
FIG. 3 shows a perspective view of a lateral cover sheet having an assembly mechanism according to a first embodiment of the present disclosure.

FIG. 3 shows a perspective view of a lateral cover sheet having an assembly mechanism according to a first embodiment of the present disclosure. The lateral cover sheet 20 is aligned to the step-shaped evaporator cover sheet 10, wherein the lateral cover sheet 20 comprises a front sheet section 21, which is in contact with the upper cover section 18 of the evaporator cover sheet 10. The lateral cover sheet 20 comprises a rear sheet section 28, which is in contact with the rear wall 9 of the housing 6. A front sheet edge 24-1 of the front sheet section 21, which is in contact with the upper cover section of the evaporator cover sheet 10, bears a mounting recess 22 of the fixing assembly 8. A locking latch 26 is formed in the mounting recess 22, which extends from the inside of the mounting recess 22 to a mouth 25 of the mounting recess 22 in opposite direction. The mounting recess 22 is formed as a channel, which can be accessed from the mouth 25 at the front sheet edge 24-1. A bottom sheet edge 24-2 of the front sheet section 21 is in contact with the ceiling front cover section 15 of the evaporator cover sheet 10. A lower sheet edge 27 of the lateral cover sheet 20 is in contact with the ceiling rear cover section 19 of the evaporator cover sheet 10.

Figure 4:
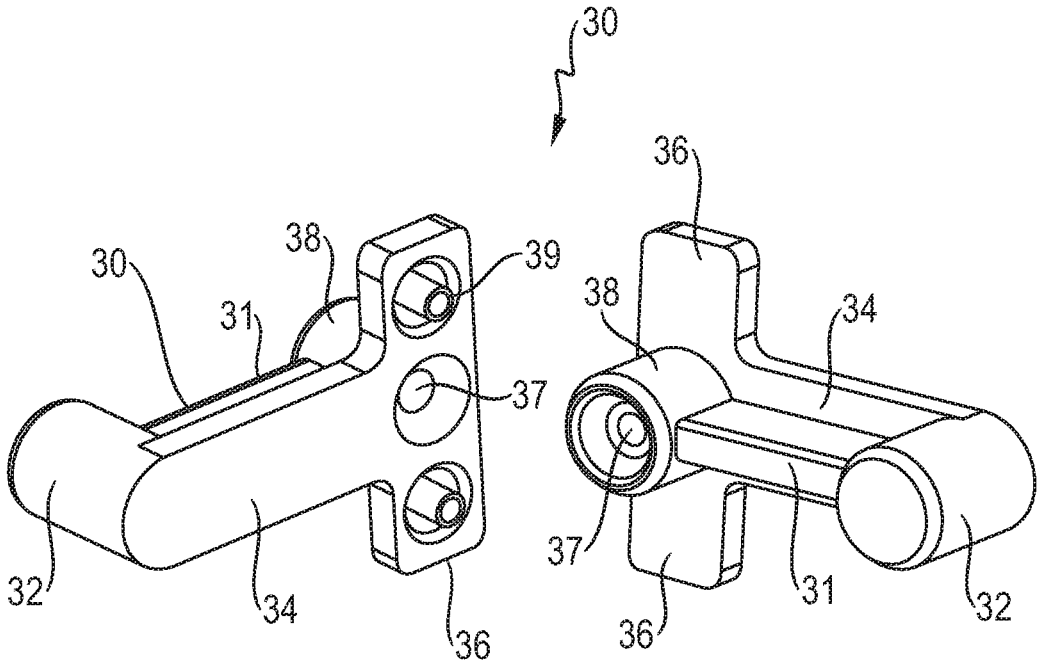
FIG. 4 shows a perspective view of a side locking element of the evaporator cover sheet according to a first embodiment of the present disclosure.

FIG. 4 shows a perspective view of a locking element of the evaporator cover sheet according to a first embodiment of the present disclosure. In FIG. 4, the frontal and rear perspective view of the locking element 30 of the evaporator cover sheet 10 is shown. The locking element 30 has a T-like form, which long edge is bent inwardly. The locking element 30 comprises a head section 38 in the middle of an arm 36, which in turn extends to two opposing sides of the side locking element 30. The head section 38 has a cylindrical structure through which a head hole 37 passes. The head section 38 is provided at an inner face of the locking element 30, and the arms 36, which in turn extend into the two opposing directions, are arranged in respect to a leg 34 in an orthogonal way. On each of the arms 36, a respective pin 39 is provided, which extends to an outer face of the locking element 30 in opposite direction in respect to the head section 38. A foot 32 is formed at the end of the leg 34. The foot 32 is formed as a short cylinder extending to the inner face of the locking element 30. On the inner face of the leg 34, a strip structured ridge 31 extends from the foot 32 to the head section 38. The locking element 30 comprises a single-piece integrated structure.

Figure 5:
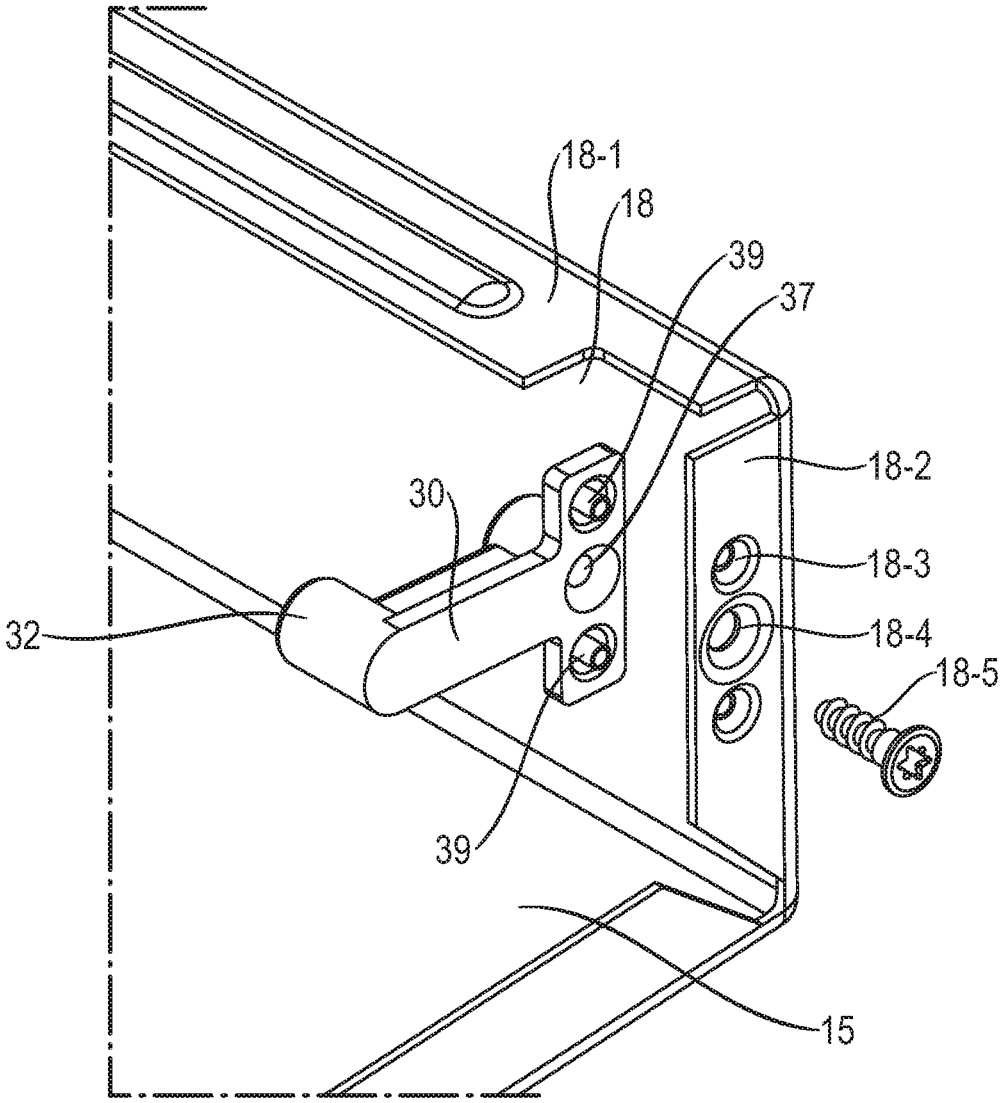
FIG. 5 shows a perspective view of a side locking element assembled at the evaporator cover sheet according to a first embodiment of the present disclosure.

FIG. 5 shows a perspective view of a locking element 30 assembled at the evaporator cover sheet 10 according to a first embodiment of the present disclosure. The connection between the locking element 30, which is part of the fixing assembly 8, and the evaporator cover sheet 10 is illustrated.

The upper cover section 18 of the evaporator cover sheet 10 is bent to form a lateral flange 18-2 towards the evaporator chamber 7. The adjacent upper edge of the upper cover section 18 is bent inwardly to form an upper flange 18-1. On the lateral flange 18-2, two lateral openings 18-3 are formed, wherein a wider lateral hole 18-4 is formed in between. The head hole 37, which is provided at the locking element 30, is aligned with the lateral hole 18-4, which is provided at the lateral flange 18-2. A lateral screw 18-5 passes through the holes 18-4, 37, and fixes the locking element 30 at the lateral flange 18-2. The pins 39 of the locking element 30 are aligned with the corresponding openings 18-3, thereby preventing that the locking element 30 can be rotated. After assembly, the foot 32 of the locking element 30 extends into the evaporator chamber 7, between the ceiling front cover section 15 and the upper cover section 18.

Figure 6:
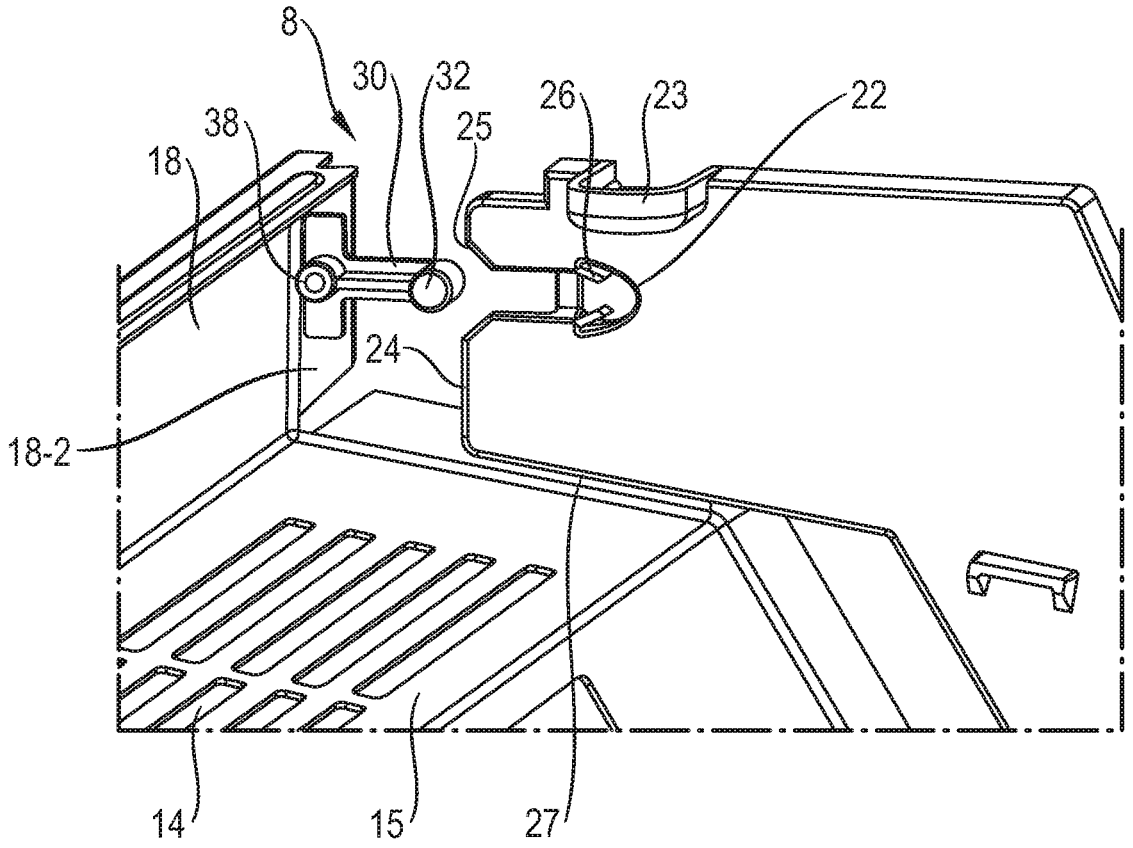
FIG. 6 shows a perspective view of an evaporator cover sheet assembled with a lateral cover sheet according to a first embodiment of the present disclosure.

FIG. 6 shows a perspective view of an evaporator cover sheet being assembled with a lateral cover sheet according to a first embodiment of the present disclosure. The locking element 30 is fixed to the lateral cover sheet 20 during the assembly. The mouth 25 at the lateral cover sheet 20 is aligned to the locking element 30. For facilitating passage, the mouth 25 is widened to enable an effective insertion of the locking element 30 into the mounting recess 22. The mounting recess 22 is dimensioned to enable a linear advancing of the locking element 30. Therefore, when the evaporator cover sheet 10 is pushed towards the lateral cover sheet 20, which in turn has been fixed to the housing 6 before, the foot 32 passes through the mouth 25 and is guided through a channel into the mounting recess 22 in a linear direction. The leg 34, which is connected to the foot 32, is also pushed into mounting recess 22 in a linear direction. When reaching the end of the mounting recess 22, the foot 32 bends the locking latch 26. Afterwards, the locking latch 26 snaps back, thereby preventing the locking element 30 from moving back. Thus, the locking element 30 seats within the mounting recess 22 to realize the fixing assembly 8. The lower sheet edge 27 of the lateral cover sheet 20 rests on the ceiling front cover section 15 of the evaporator cover sheet 10, which facilitates an effective alignment of the locking element 30 and the mounting recess 22, when the upper cover section 18 is pushed towards the lateral cover sheet 20.

Figure 7:
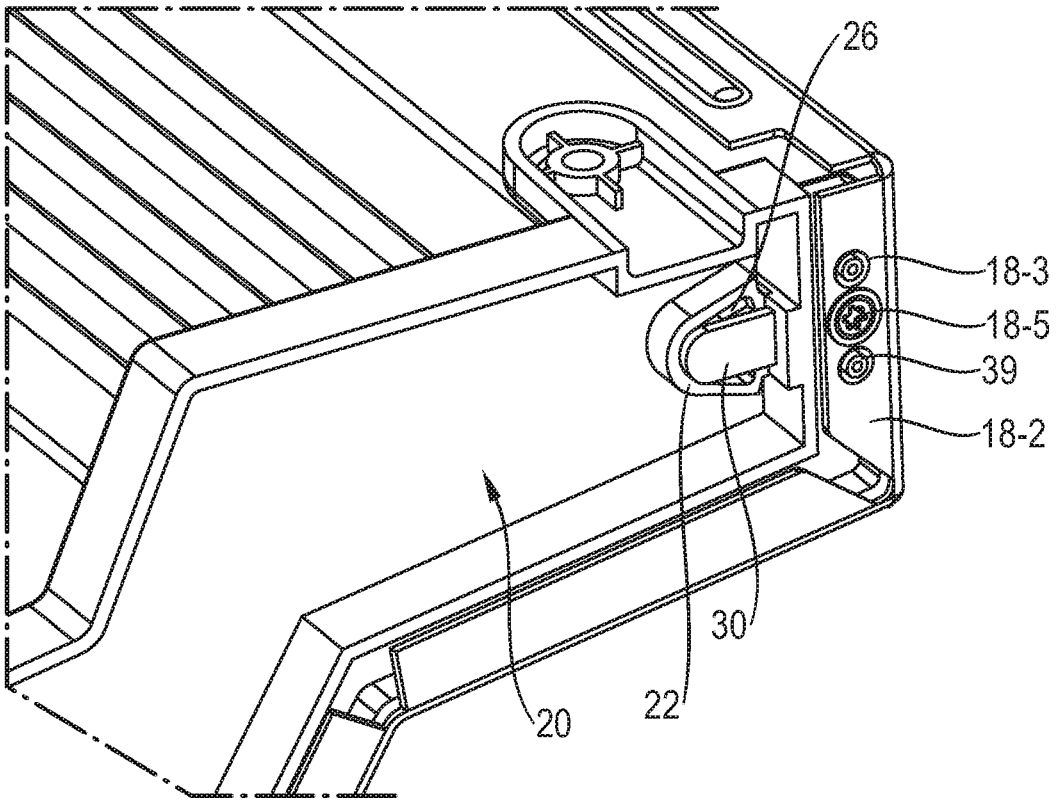
FIG. 7 shows a perspective view of an evaporator cover sheet assembled with a lateral cover sheet according to a first embodiment of the present disclosure.

FIG. 7 shows a perspective view of an evaporator cover sheet assembled with a lateral cover sheet according to a first embodiment of the present disclosure. The evaporator cover sheet 10 is fixed to the lateral cover sheet 20 by the fixing assembly 8. When the locking element 30 is positioned inside the mounting recess 22, there is no extension on the outer section. The lateral cover sheet 20 is aligned with the lateral flange 18-2 of the upper cover section 18. Thus, the housing 6, which is formed as a liner, can be easily adapted to the lateral planar edges. When the mounting person or the service technician assembles the evaporator cover sheet 10, the evaporator cover sheet 10 is easily pushed into the housing 6, wherein the locking protrusion 30 passes through the mouth 25, advances and is finally interlocked within the mounting recess 22 at least to realize a pre-fixation. Thus, other fastening elements 11 can be easily applied to the evaporator cover sheet 10. The mounting recess 22 is configured to prevent back moving of the locking element 30.

Figure 8:
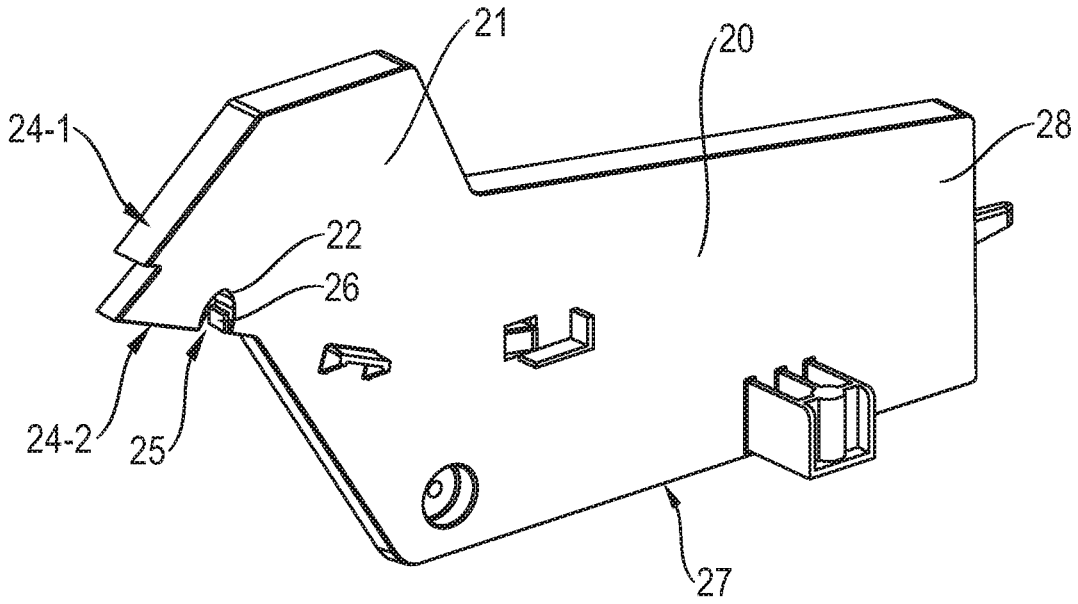
FIG. 8 shows a perspective view of a lateral cover sheet having an assembly mechanism according to a second embodiment of the present disclosure.

FIG. 8 shows a perspective view of a lateral cover sheet having an assembly mechanism according to a second embodiment of the present disclosure. Similar to the first embodiment, the later cover sheet 20 according to the second embodiment comprises a front sheet section 21 having a front sheet edge 24-1 and a bottom sheet edge 24-2, comprises a rear sheet section 28 and comprises a lower sheet edge 27. The front sheet edge 24-1 is bent inwards in respect to the bottom sheet edge 24-2. The front sheet edge 24-1 is in contact with the upper cover section 18 of the evaporator cover sheet 10. The mounting recess 22 of the fixing assembly 8 is positioned at the bottom sheet edge 24-2. A locking latch 26 is formed in the mounting recess 22, which extends from the inside of the mounting recess 22 to a mouth 25 of the mounting recess 22 in opposite direction.

Figure 9:
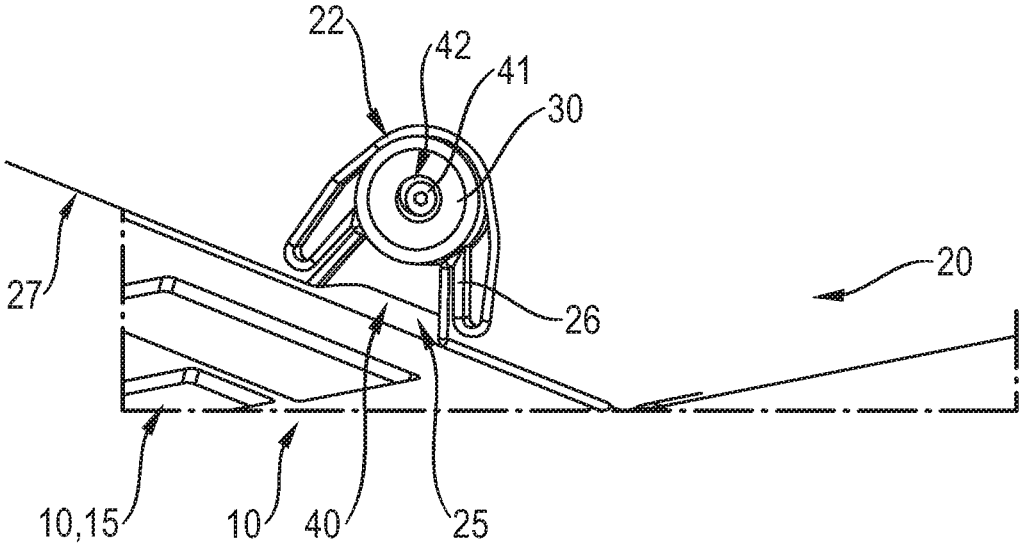
FIG. 9 shows a perspective view of an evaporator cover sheet assembled with a lateral cover sheet according to a second embodiment of the present disclosure.

FIG. 9 shows a perspective view of an evaporator cover sheet assembled with a lateral cover sheet according to the second embodiment of the present disclosure. The locking element 30, which is fixed to the evaporator cover sheet 10 interlocks with the mounting recess 22 of the lateral cover sheet 20.

First, the locking element 30, i.e. formed as plastic, is fixed at the ceiling flange 40 of the ceiling front cover section 15 of the evaporator cover sheet 10 by ceiling screw 41. The locking element 30 according to the second embodiment is formed as an cylindrical sleeve comprising a sleeve hole 42. The ceiling screw 41 is driven through the sleeve hole 42 and fixes the locking element 30 on the ceiling flange 40.

When inserting the side locking element 30 into the mounting recess 22, the mouth 25 is widened to enable an effective insertion of the side locking element 30 into the mounting recess 22. Due to the elastic properties of the cylindrical sleeve, the side locking element 30 is compressed during insertion, thereby allowing the side locking element 30 to be pushed along the locking latch 26 till the end of the mounting recess 22. When reaching the end of the mounting recess 22, the locking latch 26 snaps back, thereby preventing the side locking element 30 from moving back. Thus, the side locking element 30 seats within the mounting recess 22 to realize the fixing assembly 8. The lower sheet edge 27 of the lateral cover sheet 20 rests on the ceiling front cover section 15 of the evaporator cover sheet 10.

Figure 10:
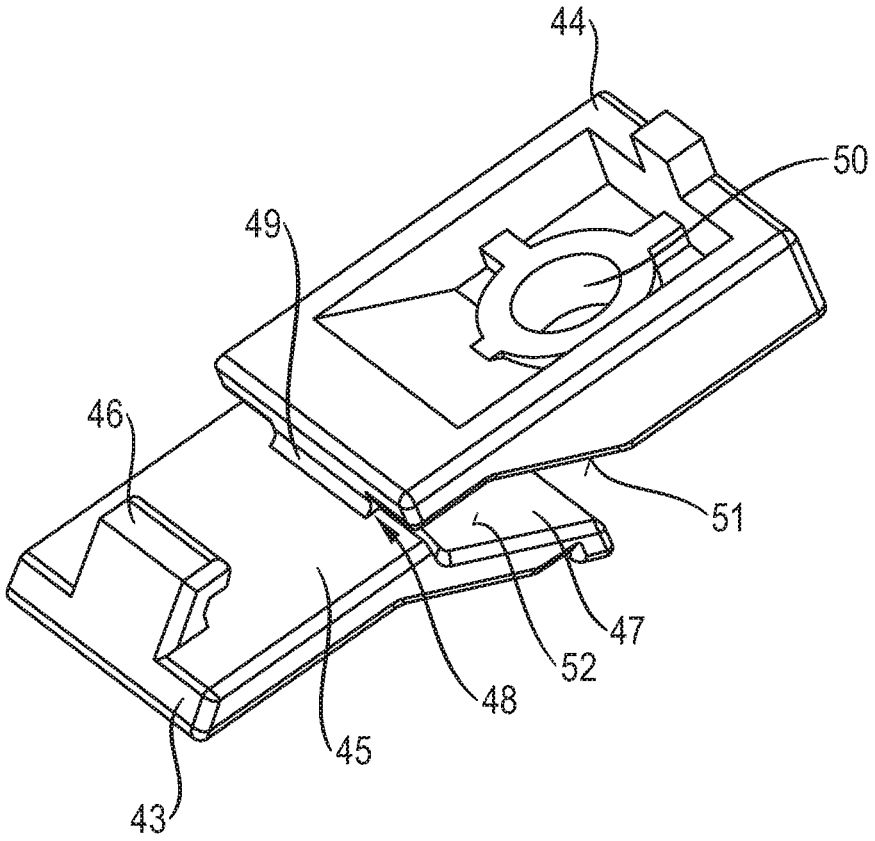
FIG. 10 shows a perspective view of a locking element of the evaporator cover sheet interlocked with a front receiving element of a housing according to a second embodiment of the present disclosure.

FIG. 10 shows a perspective view of a locking assembly of the evaporator cover sheet interlocked with a top wall of the housing according to a second embodiment of the present disclosure.

The locking element 45 comprises a mounting section 44, an interlocking section 43 and an elastic section 48 which connects the mounting section 44 and the interlocking section 43 in a bendable way. The mounting section 44 comprises a mounting hole 50 through which the mounting section 44 can be connected to the housing 8 by a screw. The locking element 45 comprises an attaching hook 46 formed at the interlocking section 43 of the locking element 45. The attaching hook 46 is inserted into a locking hole 53 of the upper cover section 18, in particular of an inwardly oriented flange, of the evaporator cover sheet 10 to releasably interlock the evaporator cover sheet 10 with the housing 6 (see FIG. 11). The elastic section 48 comprises a hinge 49, e.g. a film hinge, to elastically tilt the interlocking section 43 with respect to the mounting section 44.

The interlocking section 43 comprises a release element 47. The release element 47 lies opposite to the attaching hook 46 with respect to the elastic section 48. The release element 47 may be activated by pushing it, e.g. with a release tool such as a screw driver, towards the mounting section 44. In particular it can be pushed or tilted until a surface 52 of the interlocking section 43 contacts a surface 51 of the mounting section.

Figure 11:
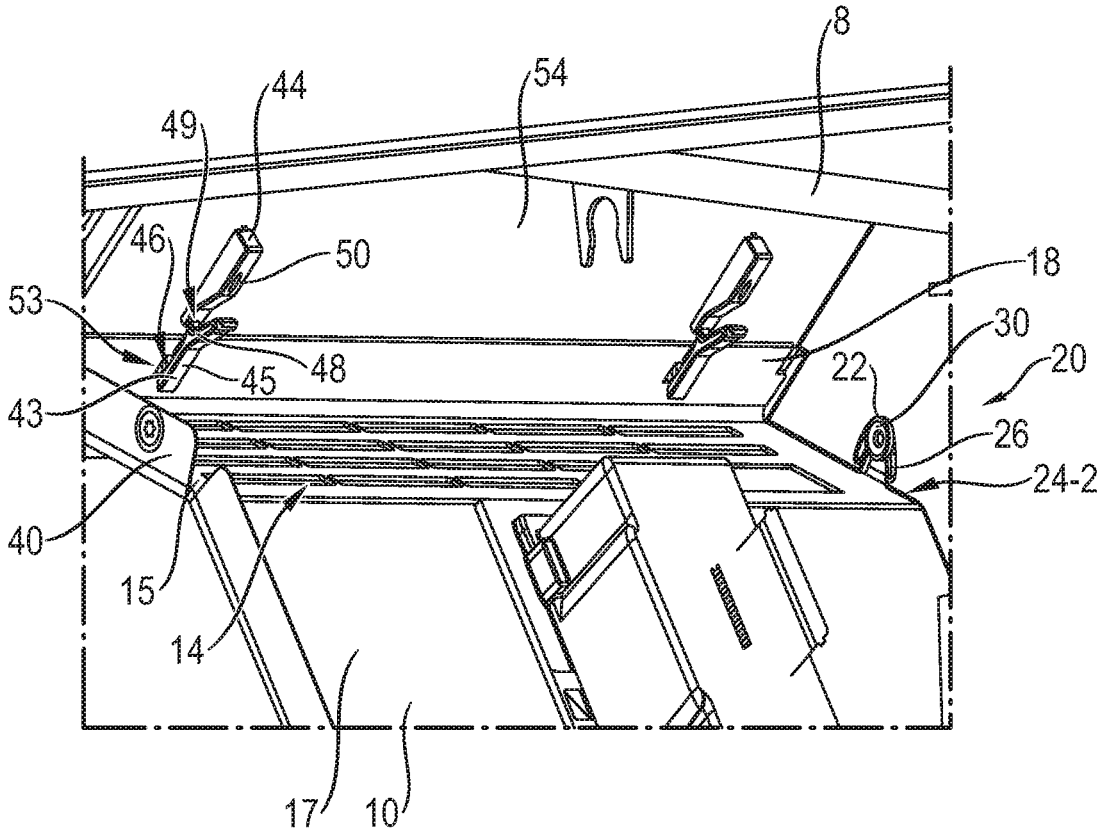
FIG. 11 shows a perspective view of an evaporator cover sheet assembled with a housing of the cooling device according to a second embodiment of the present enclosure.

FIG. 11 shows a perspective view of an evaporator cover sheet 10 assembled with a housing of the cooling device according to the second embodiment of the present enclosure. The evaporator cover sheet 10 is fixed to the housing 8 of the cooling device by two locking elements 45 and is fixed to the lateral cover sheet 20 by two locking elements 30. The evaporator cover sheet 10 comprises an upper cover section 18, a ceiling front cover section 15 with air ducts 14 and a display cover section 17.

The locking element 30, which is formed as a cylindrical sleeve is fixed to a ceiling flange 40 of the ceiling front cover section 15. The locking element 30 is inserted in a mounting recess 22 formed at the bottom sheet edge 24-2 of the lateral cover sheet 20. Locking latches 26 lock the locking element 30 within the mounting recess 22 and prevent or reduce the risk that the locking element 30 can be accidently withdrawn from the mounting recess 22.

The mounting section 44 is fixed to the housing 8 of the cooling device, in particular to a front housing section 54 of the housing 8 by a receiving screw, which is driven through a receiving hole 50 of the mounting section 44.

The locking element 45 is made from one piece.

Thereby by pushing the evaporator cover sheet 10 towards the housing 8, both the locking element 30 and the locking element 45 effectively connect the evaporator cover sheet 10 with the housing 8.

Figure 12:
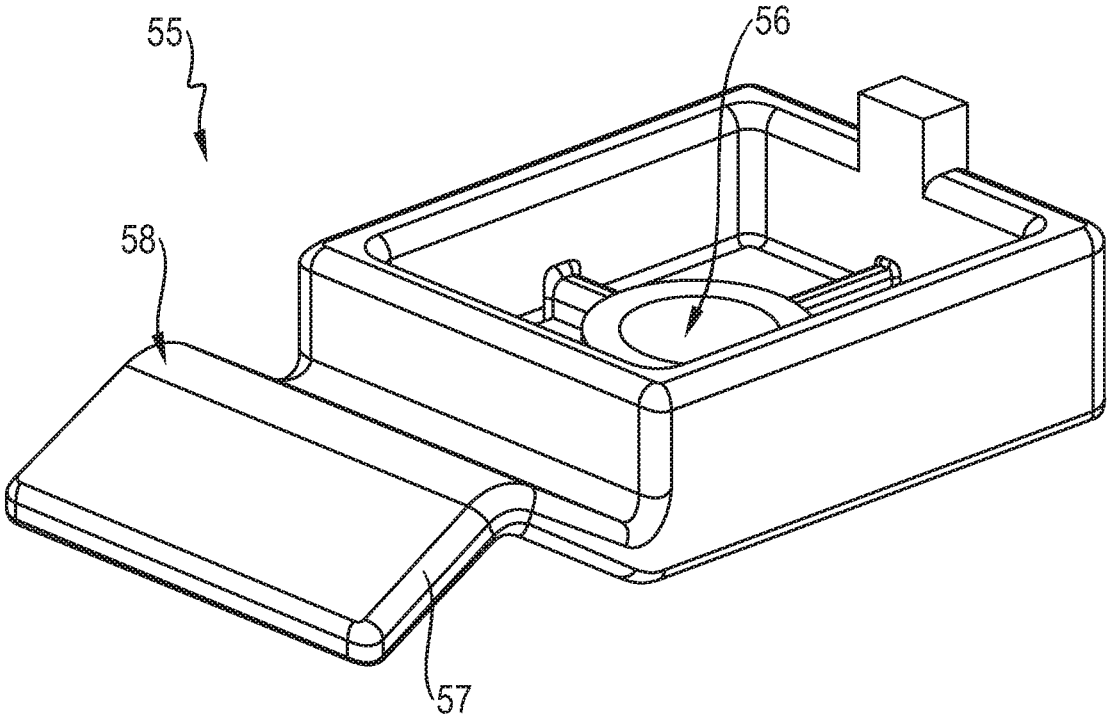
FIG. 12 shows a perspective view of a locking element according to a third embodiment of the present disclosure.

FIG. 12 shows a perspective view of an additional locking element according to a third embodiment of the present disclosure. The additional locking element 55 is positioned at the housing 6 of the cooling device by driving an additional screw through an additional hole 56 of the additional locking element 55. The additional locking element 55 further comprises an additional locking section 57, which is configured to lock the evaporator cover sheet 10 the housing 6. The additional locking section 57 comprises a bulge 58. The bulge 58 can be elastically deformed and contacts a wall of the housing 6 to which the additional locking element 55 is screwed. The evaporator cover sheet 10, in particular a flange thereof, may be clamped between the bulge 58 and the housing 6. The evaporator cover sheet 10 may comprise a mounting recess which receives the bulge 58, e.g. a locking hole. The bulge 58 may, however, also clamp the evaporator cover sheet 10 at a flange portion thereof without penetrating a mounting recess.

While preferred embodiments of the disclosure have been described herein, many variations are possible which remain within the concept and scope of the invention. Such variations would become clear to one of ordinary skill in the art after inspection of the specification and the drawings. The disclosure therefore is not to be restricted except within the spirit and scope of any appended claims.

The following is a summary list of reference numerals and the corresponding structure used in the above description of the invention:

1 Cabinet
2 Upper cabinet section
3 Hinge
4 Column
5 Display
6 Housing
7 Evaporator chamber
8 Fixing assembly
9 Rear wall
10 Evaporator cover sheet
11 Fastening element
12 Collar
13 Switch
14 Air duct
15 Ceiling front cover section
16 Lateral cover edge
17 Display and/or control cover section
18 Flange
18-1 Upper flange
18-2 Lateral flange
18-3 Lateral opening
18-4 Lateral hole
18-5 Lateral screw
19 Ceiling rear cover section
20 Lateral cover sheet
21 Front sheet section
22 Mounting recess
23 Upper protrusion
24-1 Front sheet edge
24-2 Bottom sheet edge
25 Mouth
26 Locking latch
27 Lower sheet edge
28 Rear sheet section
30 Locking element
31 Ridge
32 Foot
34 Leg
36 Arm
37 Head hole
38 Head section
39 Pin
40 Ceiling flange
41 Ceiling screw
42 Sleeve hole
43 Interlocking section
44 Mounting section
45 Locking element
46 Attaching hook
47 Release element
48 Elastic portion
49 Joint
50 Mounting hole
51 Surface
52 Surface
53 Hole
54 Front housing section
55 Additional locking element
56 Additional hole
57 Additional locking section
58 Bulge

The invention claimed is:

1. A cooling device having an evaporator for cooling a cooling chamber of the cooling device, comprising:

a heat insulated cabinet;

a housing, which is surrounded by the cabinet;

an evaporator chamber for receiving the evaporator, the evaporator chamber is closed by an evaporator cover sheet, which is fixed to a mount of the cooling device; and a fixing assembly, which is configured to releasably interlock the evaporator cover sheet with the mount by insertion of the evaporator cover sheet towards the mount, the fixing element including a locking projection and mounting recess configured for receiving the locking projection therein in an insertion direction, the mounting recess having a locking latch disposed at an edge of the mounting recess and having a longitudinal extent extending along the insertion direction into the mounting recess, the locking latch being deflectable by the locking projection during a displacement of the locking projection into the mounting recess.

2. The cooling device according to claim 1, wherein the evaporator cover sheet is fixed to the mount and/or to a further mounting of the cooling device by a screw connection.

3. The cooling device according to claim 1, wherein the mount is embodied by the housing.

4. The cooling device according to claim 1, wherein the mount is embodied by a lateral cover sheet fixed to the housing.

5. The cooling device according to claim 1, wherein the locking projection includes a cylindrical portion and the mounting recess is configured to receive the cylindrical portion, the locking latch having a free end engaging a circumferential surface of the cylindrical portion in a locked position of the locking projection in the mounting recess.

6. The cooling device according to claim 1, wherein the locking projection has a head section, which connects the locking projection with the evaporator cover sheet or with the mount, and wherein the locking projection has a foot, which is inserted into the mounting recess, wherein the foot and the head section are connected by a leg of the locking projection.

7. The cooling device according to claim 1, wherein the locking projection is fixed to the evaporator cover sheet or to the mount at least by a screw connection.

8. The cooling device according to claim 1, wherein the cooling device includes a lateral cover sheet, which is fixed to the housing, and the mounting recess is provided at a sheet edge of the lateral cover sheet.

9. The cooling device according to claim 1, wherein the evaporator cover sheet includes an inwardly oriented flange on which a locking hole is positioned embodying the mounting recess.

10. The cooling device according to claim 1, wherein the fixing assembly is completely covered by the evaporator cover sheet.

11. The cooling device according to claim 1, wherein the fixing assembly includes a release to release the interlock between the evaporator cover sheet and the mount.

* * * * *